US008858402B2

(12) United States Patent
Bruschke et al.

(10) Patent No.: US 8,858,402 B2
(45) Date of Patent: Oct. 14, 2014

(54) EXERCISE SLIDE BOARD

(75) Inventors: Lacey Bruschke, Salt Lake City, UT (US); Erin Wathen, Cottonwood Heights, UT (US); Richard Green, Salt Lake City, UT (US)

(73) Assignee: Obsidian Products, LLC, Salt Lake City, UT (US)

( * ) Notice: Subject to any disclaimer, the term of this patent is extended or adjusted under 35 U.S.C. 154(b) by 191 days.

(21) Appl. No.: 13/178,371

(22) Filed: Jul. 7, 2011

(65) Prior Publication Data

US 2012/0010051 A1 Jan. 12, 2012

Related U.S. Application Data

(60) Provisional application No. 61/362,174, filed on Jul. 7, 2010, provisional application No. 61/370,681, filed on Aug. 4, 2010.

(51) Int. Cl.

| | |
|---|---|
| ***A63B 22/00*** | (2006.01) |
| ***A63B 21/02*** | (2006.01) |
| ***A63B 23/00*** | (2006.01) |
| ***A63B 69/00*** | (2006.01) |
| ***A63B 22/20*** | (2006.01) |

(52) U.S. Cl.

CPC ..... *A63B 22/20* (2013.01); *A63B 69/0022* (2013.01); *A63B 22/0015* (2013.01)

USPC ..... 482/51; 482/123; 482/148

(58) Field of Classification Search

USPC ..... 482/23, 44, 51–52, 70–71, 79, 123, 482/142, 148, 904

See application file for complete search history.

(56) References Cited

U.S. PATENT DOCUMENTS

| | | | | |
|---|---|---|---|---|
| 5,393,282 | A * | 2/1995 | Maclean | 482/70 |
| 5,957,819 | A * | 9/1999 | Cortesi | 482/121 |
| 6,299,569 | B1 * | 10/2001 | Rich | 482/123 |
| 2006/0223395 | A1 * | 10/2006 | Wang | 442/38 |

* cited by examiner

*Primary Examiner* — Loan H Thanh
*Assistant Examiner* — Jennifer M Deichl
(74) *Attorney, Agent, or Firm* — R. Whitney Johnson; Stoel Rives LLP

(57) ABSTRACT

An exercise slide board is disclosed having a main board, a pair of backstops and a floor grip device. The main board has a top surface and a bottom surface. The top surface is smooth and low friction to allow a user wearing low-friction footwear to easily slide across the board. The first and second backstops are positioned at or near a first end of the main board and a second end of the main board, respectively. The first and second backstops may have a base surface configured to abut against the top surface of the main board. The first and second backstops may also have a strike surface facing toward a center of the main board and extending away from the top surface of the main board at an angle away from the center of the board. The floor grip device is affixed on the bottom surface of the main board. The floor grip device is configured to grip both a hard flooring surface and a carpeted flooring surface. A non-slip mesh may be used. The floor grip device may grip the flooring surface so as to create a frictional force to secure the main board relative to the flooring surface in response to and against lateral forces applied in a direction planar to the flooring surface and transverse to and against the strike surfaces of the backstops.

15 Claims, 17 Drawing Sheets

EXERCISE SLIDE BOARD

RELATED APPLICATIONS

This application claims the benefit under 35 U.S.C. §119 (e) of U.S. Provisional Patent Application No. 61/362,174, filed Jul. 7, 2010, and entitled EXERCISE SLIDE BOARD, and U.S. Provisional Patent Application No. 61/370,681, filed Aug. 4, 2010, and entitled EXERCISE SLIDE BOARD, which are both hereby incorporated by reference herein in their entirety.

TECHNICAL FIELD

The present disclosure relates generally to slide boards used for exercise.

BRIEF DESCRIPTION OF THE DRAWINGS

A more particular description will be rendered by reference to the attached drawings. Understanding that the accompanying drawings depict only typical embodiments, and are, therefore, not to be considered limiting of the disclosure's scope, the embodiments will be described and explained with specificity and detail in reference to the accompanying drawings in which.

DETAILED DESCRIPTION OF PREFERRED EMBODIMENTS

Figure 1:
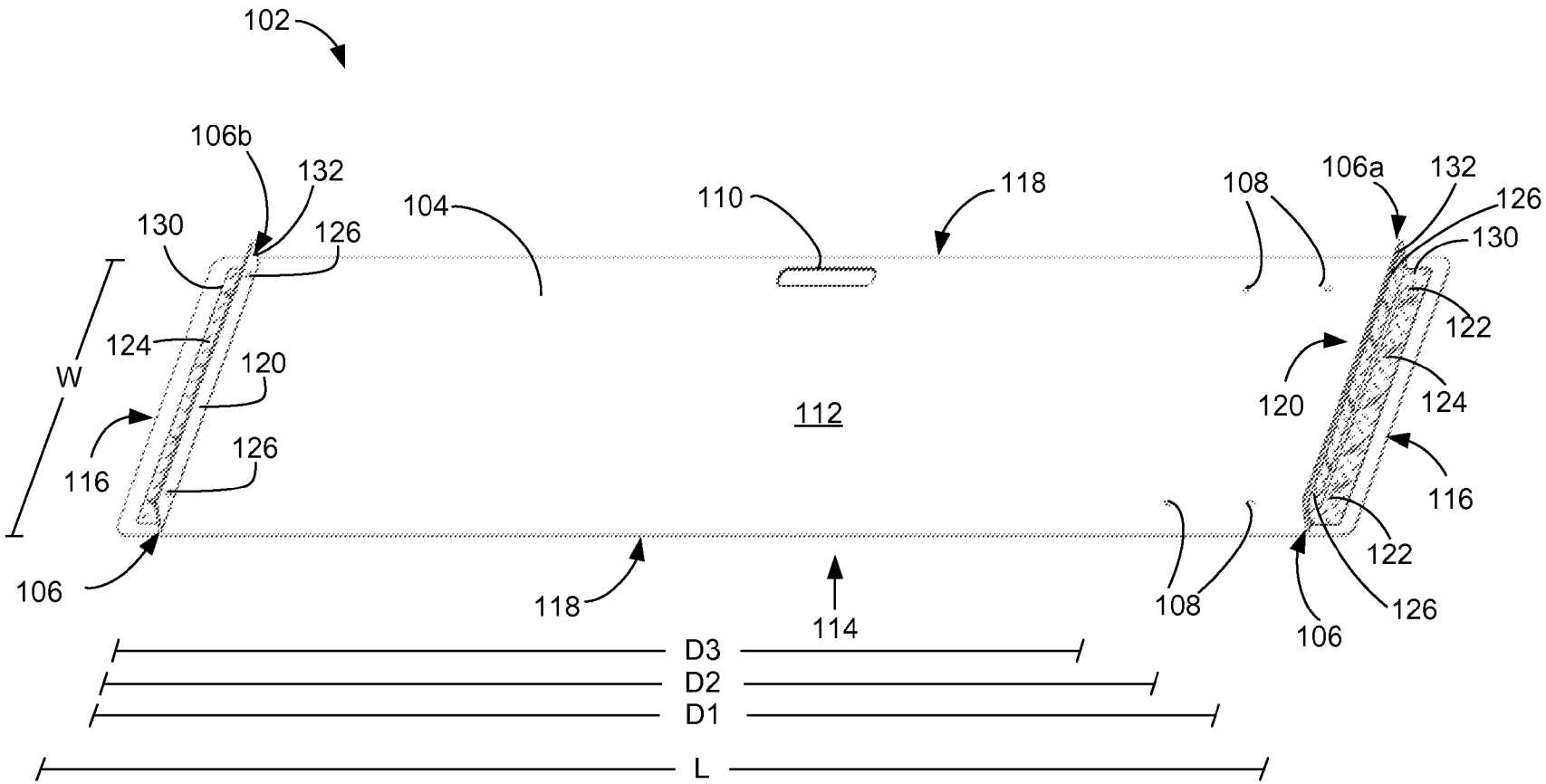
FIG. 1 is a perspective view of an exercise slide board, according to one embodiment.

The presently preferred embodiments will be best understood by reference to the drawings, wherein like parts are designated by like numerals throughout. It will be readily understood that the components, as generally described and illustrated in the figures herein, could be arranged and designed in a wide variety of different configurations. Thus, the following more detailed description of the embodiments of the apparatus is not intended to limit the scope as claimed, but is merely representative of presently preferred embodiments. Specific examples are given to illustrate aspects but those of skill in the relevant art(s) will understand that other examples may also fall within the meaning of the terms used.

The slide board is a fitness tool that is extremely popular in sport conditioning and rehabilitation settings. Since the slide board uses a gliding movement, it is a low impact activity. This means it provides a challenging workout, albeit one that is safe for the joints. Recently, it has become popular as a home fitness tool. The present disclosure provides a slide board that is unique in numerous ways and allows for some exercises not possible on other devices on the market.

FIGS. 1-7 illustrate an exercise slide board 102, according to one embodiment of the present disclosure.

Referring generally and collectively to FIGS. 1-7, the slide board 102 may comprise a main board 104, backstops 106, backstop adjustment holes 108, and a handle 110. The main board 104 has a top surface 112 on which a user slides, a bottom surface 114, lateral sides 116 defining a width W, and elongate sides 118 defining a length L. An individual (user) can use the slide board 102 as a fitness tool by standing (in low-friction footwear) on the top surface 112 of the main board 104 near a first backstop **106*a*, placing a foot against a strike surface 120 of the first backstop 106*a*, and using a leg to push off the first backstop 106*a* to slide across the main board 104. The user slides from the first lateral side 106*a* in the direction of the second backstop 106*b* positioned at the second lateral side 106*b*. The individual can then use the other foot and leg to push off the second backstop 106*b* in the direction of the first backstop 106*a*. The individual can achieve an aerobic workout by gliding back and forth between the backstops 106** for an extended period.

The main board 104 of the slide board 102 may be formed of high density polyethylene (HDP). HDP can be formed to have a very dense and smooth surface that is impervious to nearly all chemicals and contaminates. The smooth surface can provide a low-friction sliding surface. The top surface 112 of the main board 104 presents a low-friction surface upon which a user can easily slide. A user may wear footwear that may also reduce frictional forces and facilitate sliding on the top surface 112 of main board 104. The hard, dense surface of the main board 104 can easily be cleaned with household cleaner. A light coat of Teflon® or silicone spray can be added to the top surface 112 to decrease friction and increase slidability. The main board 104 may be available in a variety of colors, including but not limited to white and black.

The backstops 106, as mentioned, may be mounted, affixed, or otherwise connected on or in abutment with the top surface 112 of the main board 104. A base surface 119 (see FIGS. 4 and 6) of the backstop 106 abuts against the top surface 112 of the main board 104. The backstops 106 are configured to provide strike surfaces 120 against which the user can push off to slide across the main board 104, as explained more fully below. Mounting hardware 122 may be used to secure the backstops 106 to the main board 104. The mounting hardware 122 of the illustrated embodiment includes threaded bolts configured to thread into a female threaded component positioned within the backstop adjustment holes 108. The female threaded component is situated at or below the top surface 112 of the main board 104 and/or between the top surface 112 and bottom surface 114 of the main board 104. The female threaded component may be configured to be firmly secured in the main board 104. For example, the female threaded component may be barbed and/or comprise a collar or head to be positioned in abutment with a bottom surface 114 of the main board 104 to prevent the female threaded component from pulling through the adjustment holes 108 in response to forces applied to the strike surface 120 of the backstops 106 in a direction transverse to a plane of the strike surface 120. The backstop 106 and/or mounting hardware 122 may also include a metal mounting plate 124, as shown.

In the illustrated embodiment, at least the first backstop 106*a* is removably mounted such that a distance between the strike surfaces 120 of the backstops 106 can be adjusted. For example, when the first backstop 106*a* is mounted using a first pair of mounting holes 108*a* (see FIG. 7), the backstops 106 are positioned a distance D1 apart. When the first backstop 106*a* is mounted using a second pair of mounting holes 108*b*, the backstops 106 are positioned a distance D2 apart. When the first backstop 106*a* is mounted using a third pair of mounting holes 108*c*, the backstops 106 are positioned a distance D3 apart.

Figure 6:
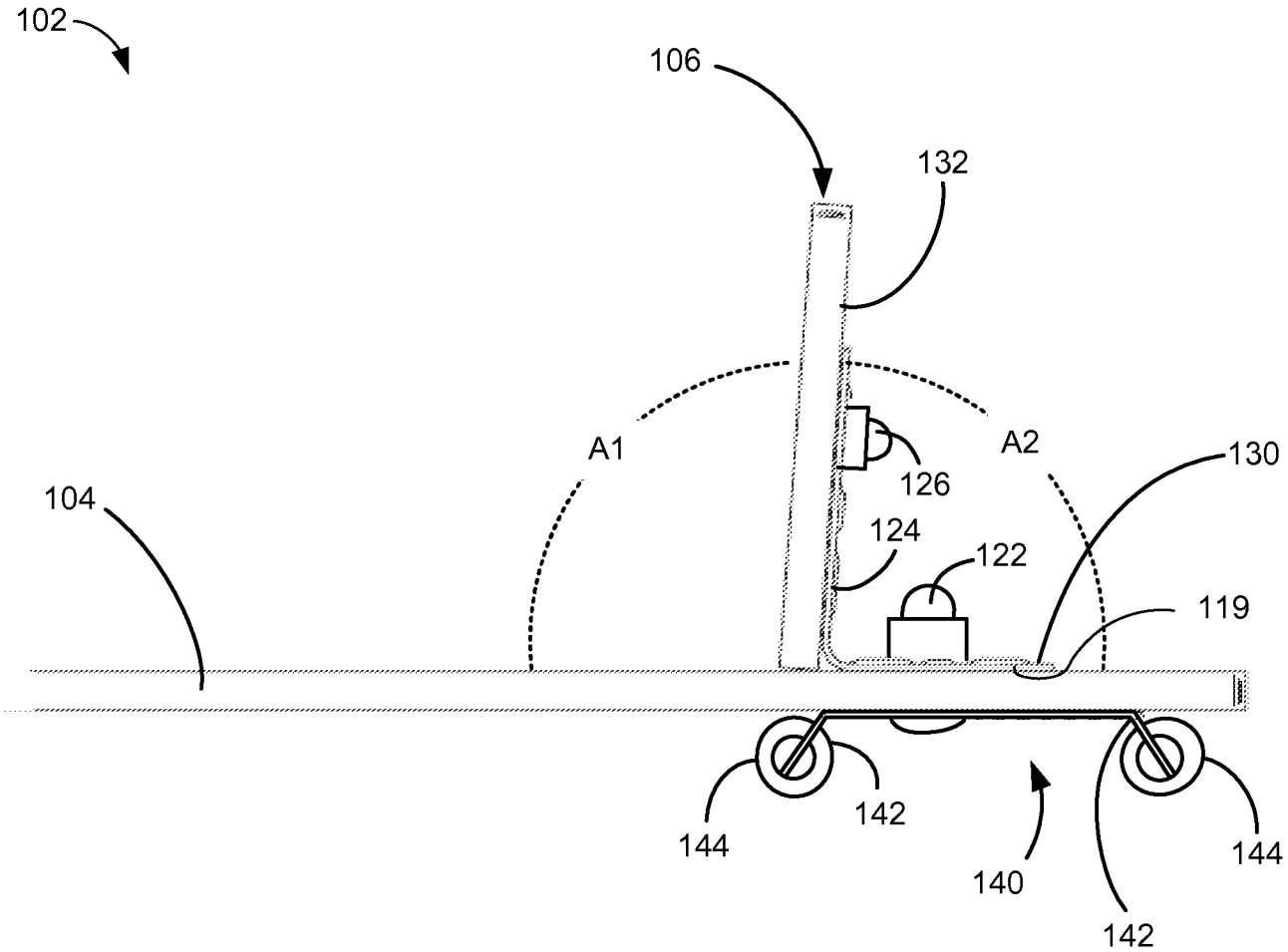
FIG. 6 is an enlarged front side elevation view of the first end of the exercise slide board of FIG. 1.
Figure 7:
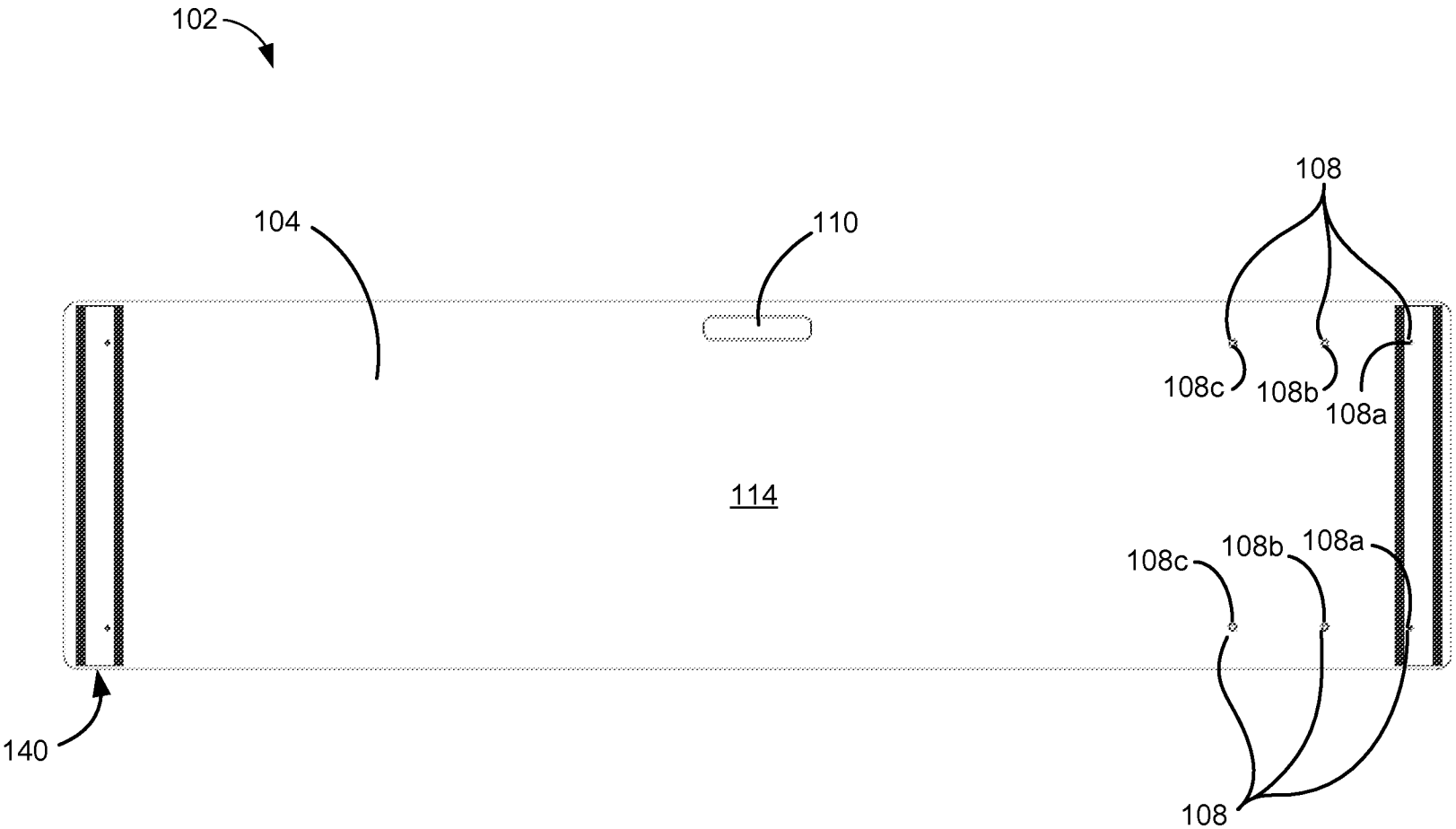
FIG. 7 is a bottom plan view of the exercise slide board of FIG. 1.

The backstops 106 of the illustrated embodiment include a base portion 130 and an upright portion 132, as best shown in FIG. 6. The base portion 130 provides the base surface 119 and the upright portion 132 provides the strike surface 120 against which the individual user can push off to propel herself/himself and slide across the slide board 102. The backstop 106 may be formed by bending a piece of material through a desired angle A1 (or otherwise forming the material, such as by thermoforming, injection molding, and the like) to present a strike surface 120 at an angle A1 relative to the main board 104. The strike surface 120 may face toward a point above the top surface 112 at the center of the main board 104. The angle A1 may be ninety degrees or larger, so as to present an appropriate strike surface 120. The angle A1 may be only slightly larger than ninety degrees so as to present a strike surface that is approximately vertical.

In one embodiment, the angle A1 between the base portion 130 and upright portion 132 of each backstop 106 may be ninety-five degrees. In another embodiment, the angle A1 may be between ninety-three degrees and ninety-seven degrees. In another embodiment, the angle A1 may be between ninety-one degrees and ninety-nine degrees. In another embodiment, the angle A1 may be between ninety and one hundred degrees. The angle A1, when larger than ninety degrees, results in the upright portion 132 of the backstop 106 (and thereby the strike surface 120) angling away from the center of the main board 104 and also away from an individual user of the slide board 102. Accordingly, when the foot of the user hits the strike surface 120, the foot is not hitting an exactly vertical, flat surface, thereby softening impact, which may reduce a risk of foot and knee stress and/or injury. An angle A1 of approximately ninety-five degrees allows the sole of a shoe that a user may be wearing to impact the strike surface 120 without a side of the shoe (and the user's foot) impacting the strike surface 120. A user may wear an athletic shoe, such as a tennis shoe, with a low-friction bootie or slipper over the shoe, when using the slide board 102, and impact with the strike surface may be limited to the sole of the shoe.

In the illustrated embodiment, the backstops 106 may be formed by bending a material into an L-shape with an angle A2 between the base portion 130 and the upright portion 132. In the illustrated embodiment, an "L-shaped" mounting plate 124 may provide support and/or attachment of the backstops 106 to the top surface 112 of the main board 104. The backstops 106 also may include and/or be formed of durable HDP, similar to the main board 104 of the slide board 102. In the illustrated embodiment, the upright portion 132 of the backstop 106 is formed of HDP coupled to the mounting plate 124 and the base portion 130 includes the mounting plate 124. A narrow piece of HDP may be coupled to the upright portion 132 to provide an enlarged strike surface 120. Mounting hardware 126 and/or another fastener, including but not limited to a bolt and nut, a rivet, an adhesive, and the like, may be used to couple the HDP to the mounting plate 124. An ordinarily skilled artisan will appreciate that the material forming the backstop 106 may be a sheet of metal (e.g., steel or aluminum diamond plate), plastic, or other bendable material.

The mounting plate 124 may be 1/16" polished aluminum diamond plate. The mounting plate 124 may be diamond plate to provide both structure and a desired aesthetic appearance. The mounting plate 124 can be bent at an angle greater than ninety degrees, such as for example a five degree reverse bend (i.e., through a ninety-five degree angle A1), to eliminate a flat strike surface on the backstop 6 (e.g., the plate 124 may be bent through an angle A1 of ninety-five degrees to form an angle A2 of eighty-five degrees).

The mounting plate 124 and/or backstop 106 can be formed of a variety of materials to provide an appropriately durable striking surface 120. For example, in another embodiment, as described below, the backstops 106 may be formed of a durable plastic, such as a polycarbonate plastic (e.g., Lexan®). A polycarbonate plastic may provide high durability and thermo-formability and a design, graphic, image, or the like can be screen-printed or otherwise affixed to a surface of the plastic.

Also, the backstops 106 may be another shape, such as square, rectangular, trapezoidal, parallelogram, or any shape that presents an appropriate strike surface 120.

Figure 2:
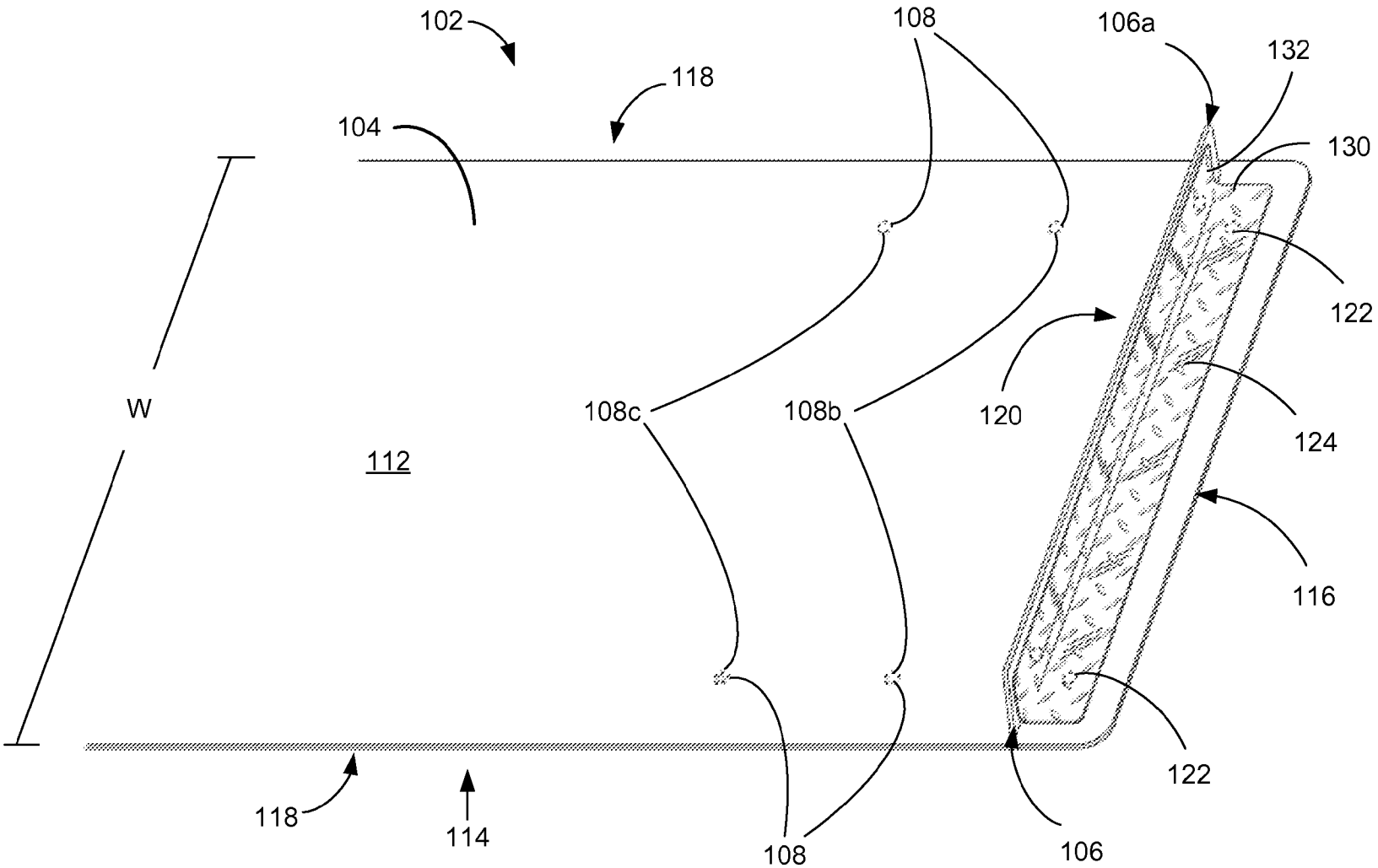
FIG. 2 is an enlarged perspective view of a first end of the exercise slide board of FIG. 1.
Figure 3:
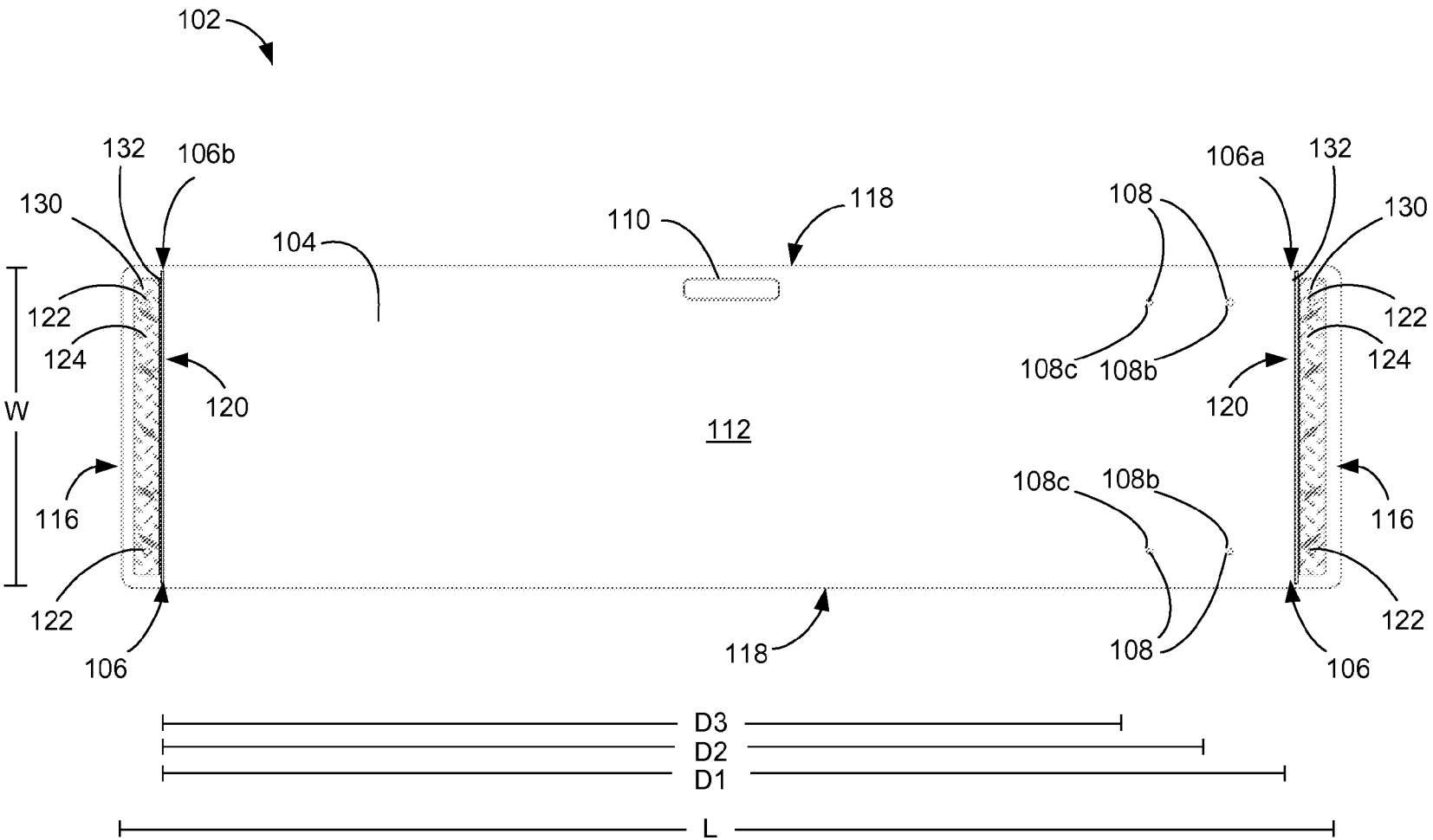
FIG. 3 is a top plan view of the exercise slide board of FIG. 1.
Figure 4:
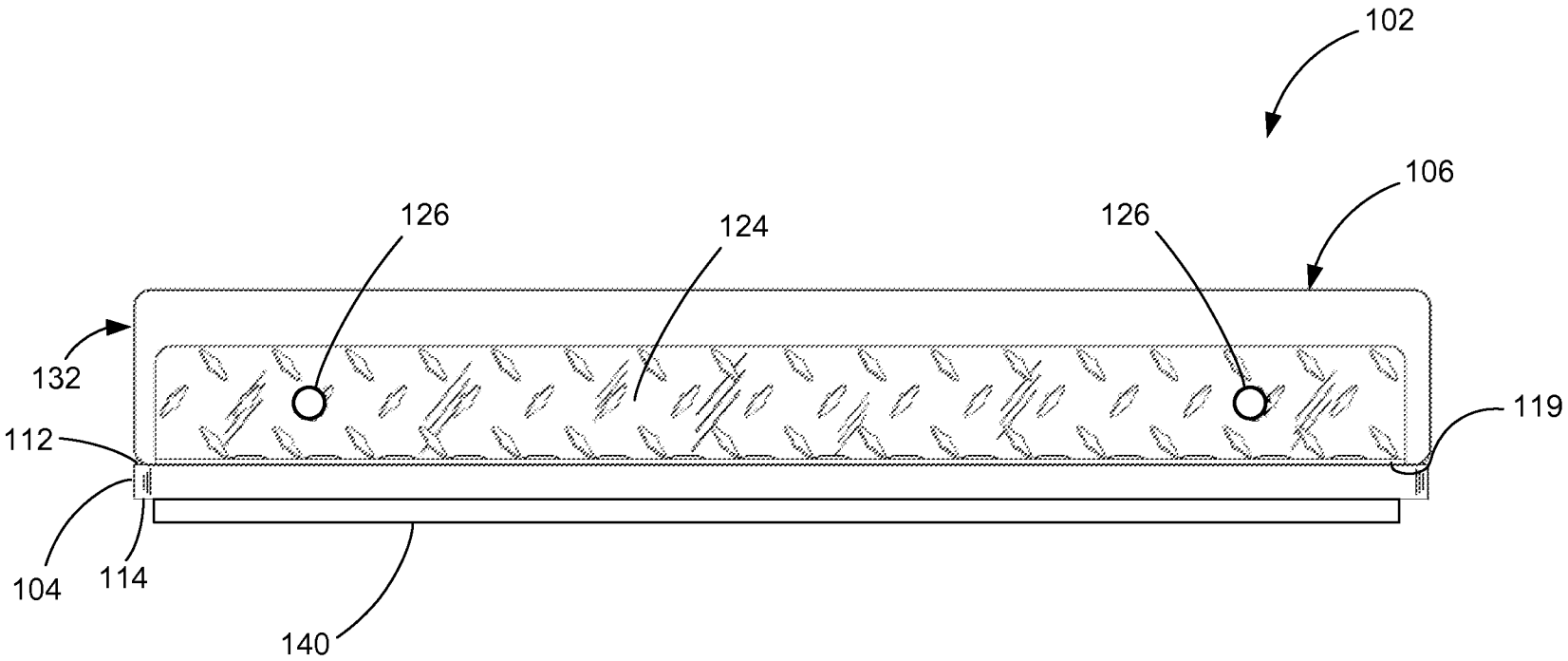
FIG. 4 is a lateral side elevation view of the exercise slide board of FIG. 1.
Figure 5:
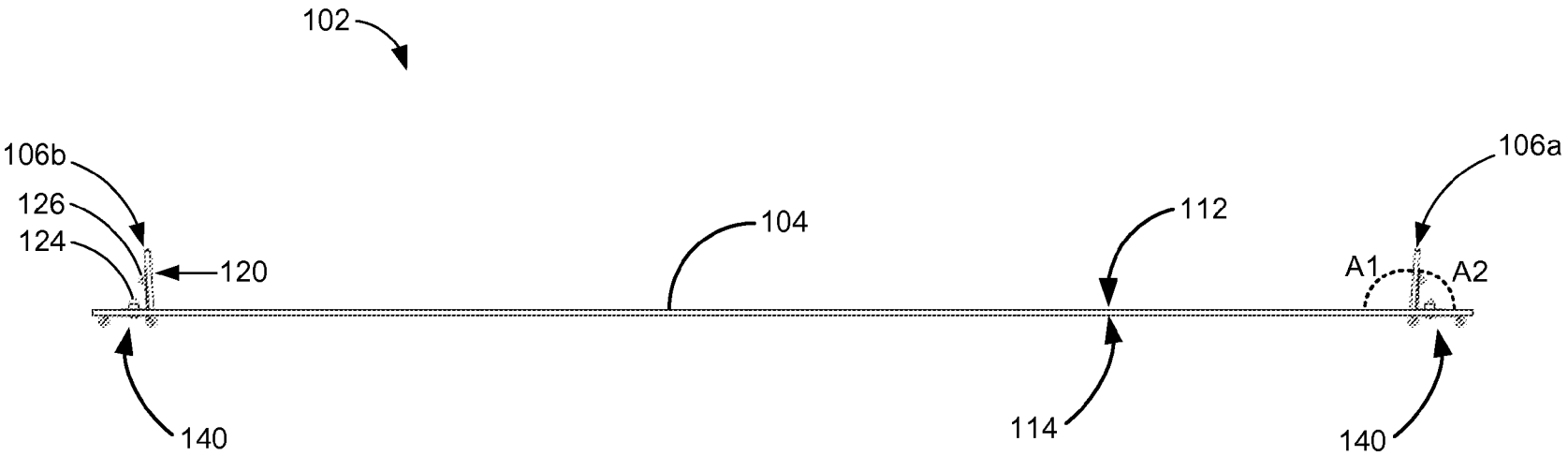
FIG. 5 is a front side elevation view of the exercise slide board of FIG. 1.

The strike surface 120, as mentioned, may be provided on an inside surface of the upright portion 132 of each backstop 106, facing the opposing backstop 106 or a point above the top surface 112 at the center of the main board 104, as depicted best in FIGS. 2, 5, and 6. Mounting hardware 122 of the backstops 106 can be located on the base portion 130, below and/or away from the strike surface 120 of the backstop 106 to avoid contact with the foot of the individual user as they push against the backstop 106.

The slide board 102 may also comprise a floor grip unit 140 on the bottom at each end of the slide board 102, as depicted in FIGS. 4-7. The floor grip unit 140 may include two legs 142 angled at forty-five degrees and configured to dig into carpet to prevent the slide board 102 from shifting while a person hits and then pushes off from the backstops 106. In the illustrated embodiment, the legs angle at forty-five degrees from vertical, in opposite directions. As can be appreciated, other configurations of legs, with varying numbers of legs 142, may be used. For example, a three-leg configuration may be used, or a single-leg configuration. Similarly, the angle of the legs may vary, for example any angle between sixty degrees and thirty degrees, to achieve varying levels of slant on the board and/or gripability.

The floor grip units 140 can also be fitted with a sleeve 144 on each leg 142 to achieve secure gripping on slick (e.g., hard) surfaces such as wood, tile, linoleum, concrete, and the like.

The sleeve 144 may be formed of neoprene, rubber, or other elastomeric material configured to facilitate frictional forces between the sleeve and a surface on which the slide board 102 may be positioned. The frictional forces generated by the sleeve 144 enable the floor grip unit 140 to grip the surface on which the slide board 102 is positioned, which reduces and/or restricts movement of the slide board 102 during use. In the illustrated embodiment, the inside leg 142 of the floor grip unit 140 may be ½ inch in length and the outside leg 142 may be ⅝ inch in length. These leg lengths may give the ends of the main board 104 a slight incline to decelerate the individual who is sliding as their feet approach the backstops 106. The floor grip units 140 may be formed of 0.050 inch aluminum. Other leg lengths are possible to achieve varying degrees of slant and for different types of surfaces. For example the inside leg 142 may be less than ¾ inch and the outside leg 142 may be less than one inch. In another embodiment, the inside leg 142 may be less than one and one half inch and the outside leg 142 may be less than two inches.

There may be a carry handle 110 cut into the HDP of the main board 104. The handle 110 may be located near the center of the main board 104 and about one inch from an edge on an elongate side 118. An accessory pull-loop can attach through this handle opening. The accessory loop can provide an attachment point for the use of cables or bands (not shown), allowing a user to use the slide board 102 for additional exercises beyond what is possible otherwise.

The use of HDP and aluminum (e.g., a diamond plate mounting plate 124 and the floor grip unit 140) may make the slide board 102 light weight. These materials may also provide a very durable and damage resistant slide board 102 that may be rust and stain resistant and not easily susceptible to scratching, breaking, bending, or appearance deterioration.

Figure 8:
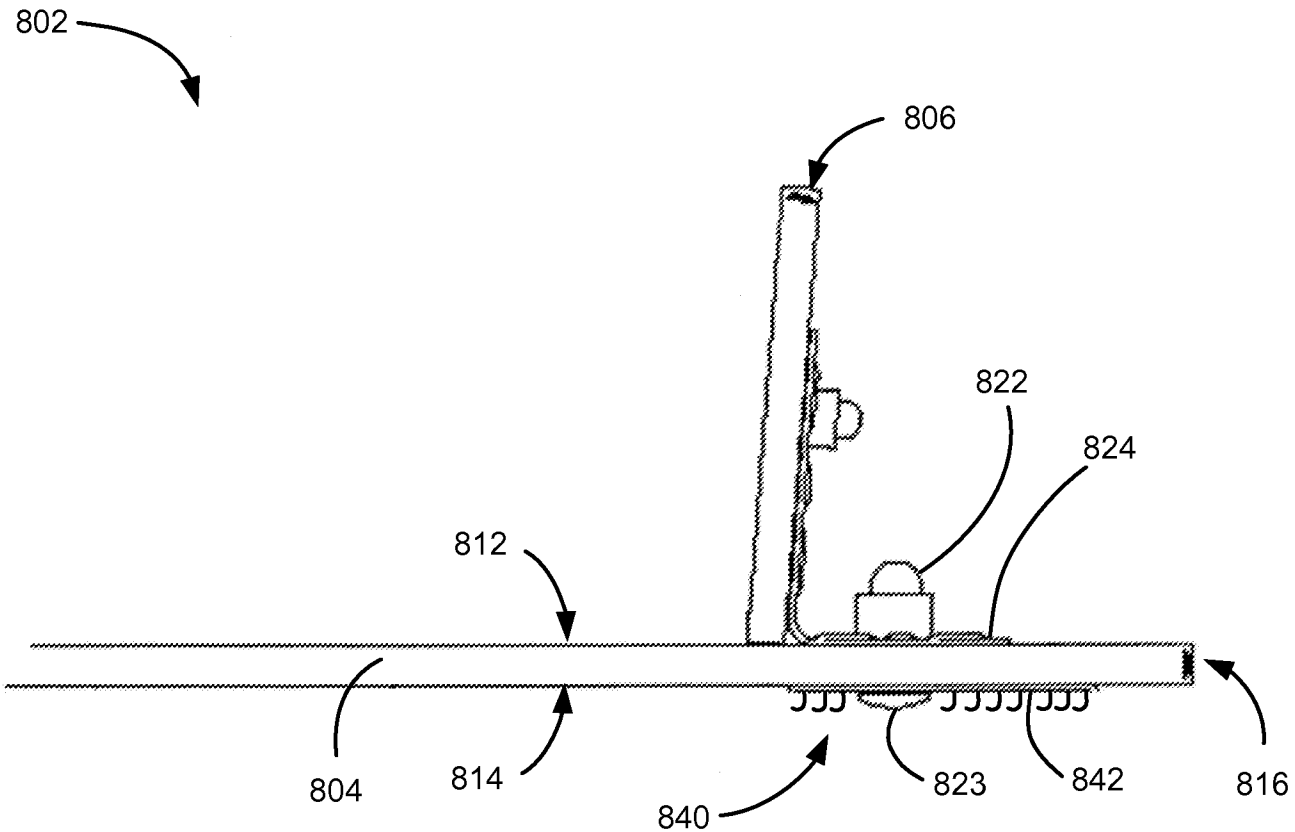
FIG. 8 is an enlarged front side elevation view of a first end of an exercise slide board, according to another embodiment.

FIG. 8 is an exercise slide board 802, according to another embodiment of the present disclosure. A backstop 806 is positioned on a top surface 812 of a main board 804. The backstop 806 includes a mounting plate 824. A floor grip unit 840 is secured to a bottom surface 814 of the main board 804. In the illustrated slide board 802, the floor grip unit 840 can be a "hook-and-loop" securement device, and more specifically the "hook" portion of a "hook-and-loop" securement device. For example, one or more Velcro® fabric grips 842 may be positioned on a bottom surface 814 of the slide board 802 in addition to, or as an alternative to the floor grip unit 840. The Velcro fabric grips 842 can be attached to the bottom surface 814 of the main board 804 of the slide board 802 using, for example, the mounting hardware 822 used to mount the backstop 806, a female threaded component 823 positioned within the backstop adjustment holes (not shown), and/or an adhesive. The Velcro fabric grips 842 may comprise a male portion (i.e., the "hook" portion) of the Velcro and may measure two inches wide.

In the illustrated embodiment, the floor grip unit 840, in this case the Velcro fabric grips 842, are configured to extend from a first elongate side to a second elongate side at a first lateral side 816 and a second lateral side 816. Stated differently, the Velcro fabric grips 842 may extend along a width of the slide board 802 and may be positioned proximate each of the lateral ends in substantially the same location as the floor grip unit 140 of the slide board 102 of FIGS. 1-7. In another embodiment, two Velcro fabric grips 842 can be mounted at each lateral end 816 of the slide board 802. In still another embodiment, the Velcro fabric grips 842 extend nearly a width of the board and may be positioned at intervals along the length of the slide board.

Figure 9:
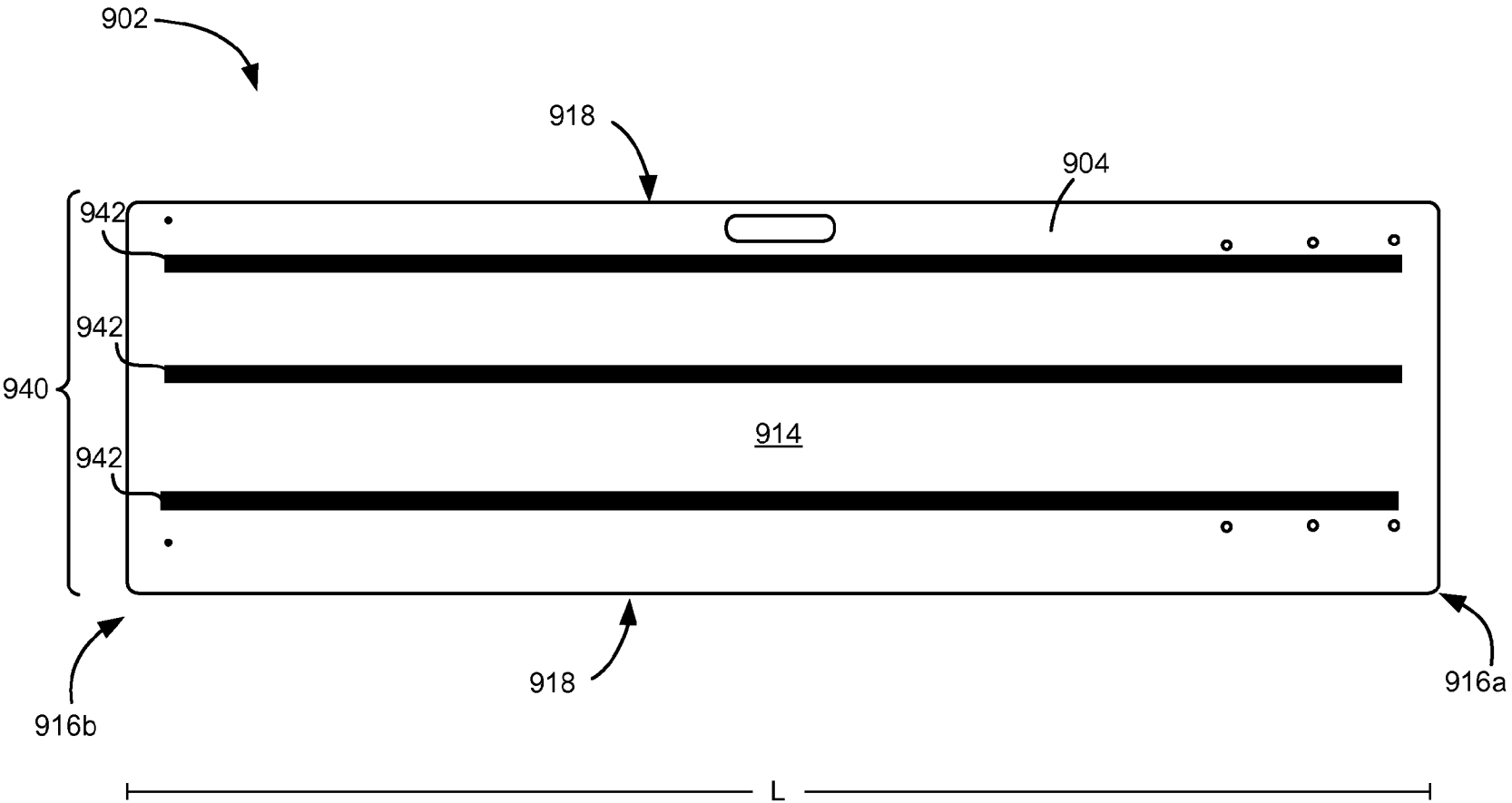
FIG. 9 is a bottom plan view of another exercise slide board, according to another embodiment.

FIG. 9 is a bottom plan view of another exercise slide board 902, according to another embodiment. A backstop 906 is positioned on a top surface 912 of a main board 904. A floor grip unit 940 is secured to a bottom surface 914 of the main board 904. In this embodiment, Velcro fabric grips 942 can be mounted along the length L of the bottom surface 914 of the slide board 902, as shown in FIG. 9. For example, two Velcro fabric grips 942 can be attached one inch in from each elongate side 918 of the slide board 902, extending between a first lateral side 916*a* and a second lateral side 916*b*. A third Velcro fabric grip 942 can be attached along the length L down a centerline of the slide board 902. In this manner, the floor grip unit 940 extends along a length of the main board 904 and provides frictional forces along the entire length L of the board to restrict movement of the slide board 902 during use.

The Velcro fabric grips 842, 942 of the embodiment 802, 902 of FIGS. 8 and 9 can also be fitted with a rubber surface. A rubber strip may be coupled with a female portion (i.e., a "loop" portion) of the Velcro on the back side, such that the rubber strip can be attached to Velcro fabric grips 842, 942 to achieve secure gripping on slick and/or hard flooring surfaces such as wood, concrete, tile, etc. In one embodiment, the rubber strip may comprise a non-slip material. The non-slip material may be configured as a rubber mesh having a woven mesh disposed between layers of rubber.

In another embodiment, the floor grip unit 940 can comprise a non-slip material attached directly to the bottom surface 914 of slide board 902 with adhesive, eliminating the need for the Velcro. The non-slip material may include, for example a non-slip rubber mesh configured to grip both a carpet flooring surface or a hard flooring surface (e.g., hardwood, tile). For example, in one embodiment, the non-slip material may be a non-adhesive shelf liner, such as Duck® brand non-adhesive Easy Liner® shelf liner (e.g., item #47550 model #1297467 at Lowe's). Attaching the non-slip material directly to the bottom surface 914 of the slide board 902 can eliminate any need to reconfigure or otherwise change the slide board 902 to adapt to flooring surface changes from one location to the next. In one embodiment, the non-slip material may cover the entire bottom surface 914 (or almost all of the bottom surface 914) of the slide board 902. In another embodiment, the non-slip material may include sections extending along a width of the slide board 902 and positioned at intervals along the length L of the bottom surface 914 of the slide board 902.

As can be appreciated, in other embodiments the floor grip unit 940 can comprise another appropriate securement device to secure the slide board 902 to the flooring surface upon which the board is placed.

Figure 10:
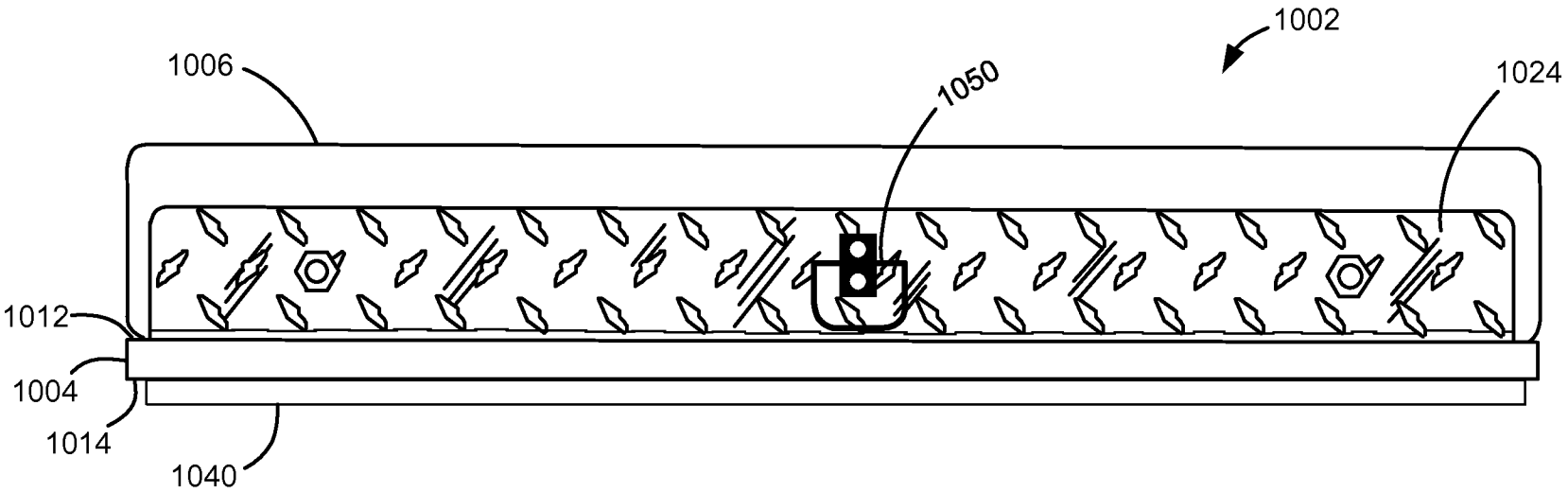
FIG. 10 is a lateral side elevation view of an exercise slide board, according to another embodiment.

FIG. 10 is a lateral side elevation view of an exercise slide board 1002, according to another embodiment. A backstop 1006 is positioned on a top surface 1012 of a main board 1004. A floor grip unit 1040 is secured to a bottom surface 1014 of the main board 1004. In the illustrated embodiment, a D-ring 1050 may be mounted to the outside surface of the mounting plate 1024 (opposite a strike surface of the backstop 1006). The D-ring 1050 provides an accessory loop that can be used as an attachment point for cables or bands (not included), allowing the user to use the slide board for additional exercises beyond what is possible with the slide board 1002 alone.

Figure 11:
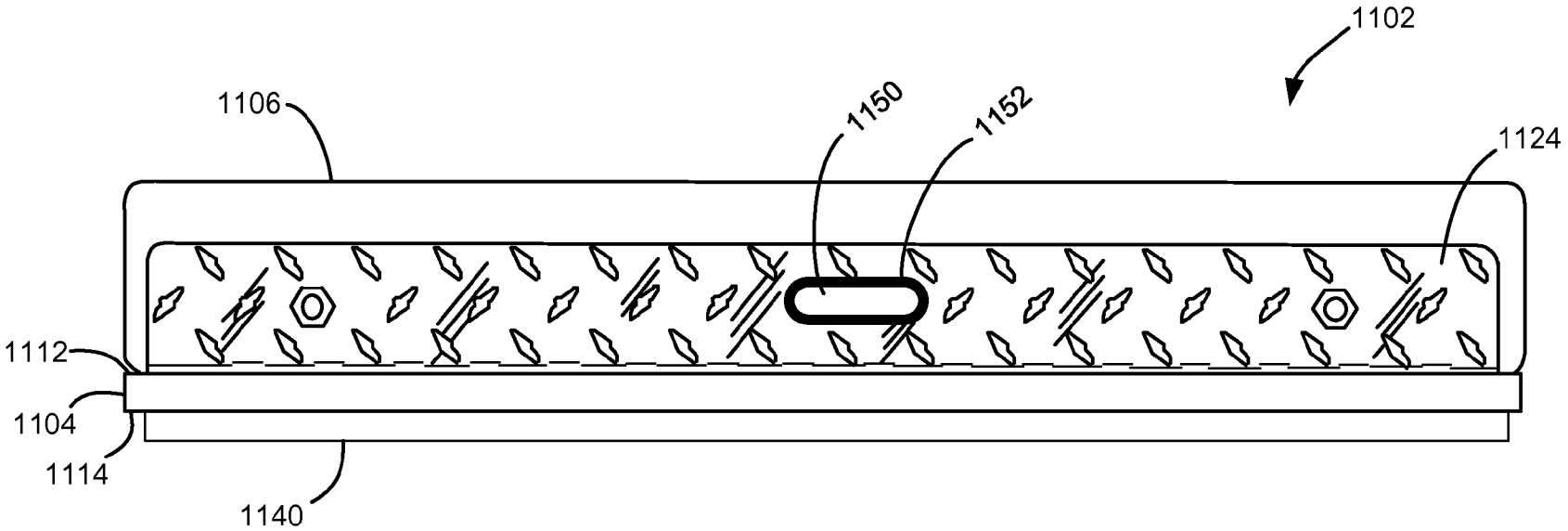
FIG. 11 is a lateral side elevation view of an exercise slide board, according to another embodiment.

FIG. 11 is lateral side elevation view of an exercise slide board 1102, according to another embodiment. A backstop 1106 is positioned on a top surface 1112 of a main board 1104. A floor grip unit 1140 is secured to a bottom surface 1114 of the main board 1104. The backstop 1106, including a mounting plate 1124, can include an opening 1150 fitted with a rubber grommet 1152. The opening 1150 can be located in the center of the backstop 1106 to provide an attachment point for cables or bands that allow the user to use the slide board for additional exercises beyond what is possible on the slide board 1102 otherwise. The opening 1150 also enables use of a door hanger accessory bracket (not shown). The door hanger accessory bracket can be received by the opening 1150 and/or abut or engage an inside edge of the rubber grommet 1152 to allow the slide board 1102 to be hung on a common bedroom/closet door. The door hanger accessory may be configured such that the slide board 1102 will not detach from the door hanger accessory and the door as the door swings when opened and shut. For example, an attachment component of the door hanger accessory may include a collar to secure the attachment component with the opening 1150 and guard against the slide board 1102 falling off the attachment component.

Figure 12:
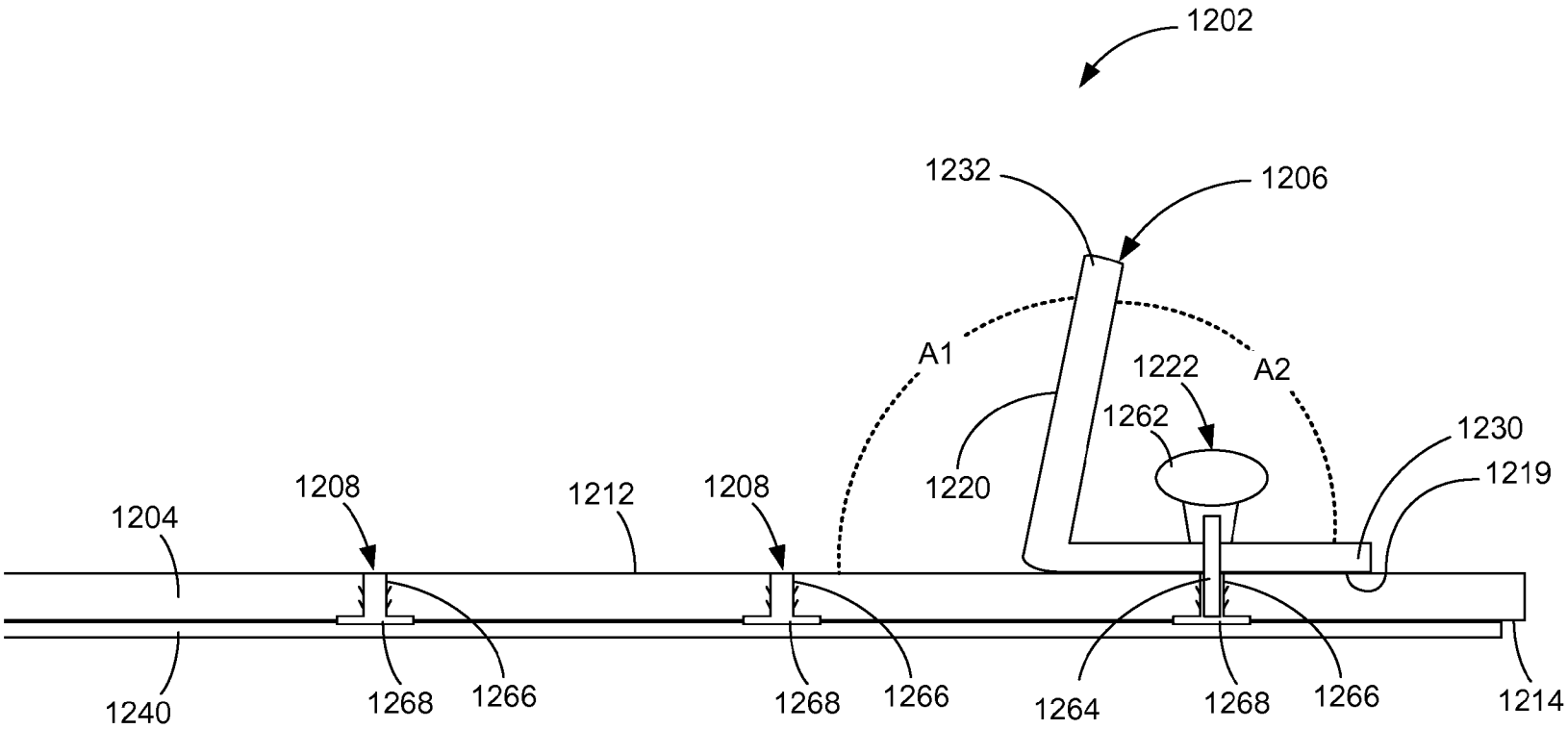
FIG. 12 is an enlarged cross-sectional front side view of a first end of an exercise slide board 1202, according to one embodiment
Figure 13:
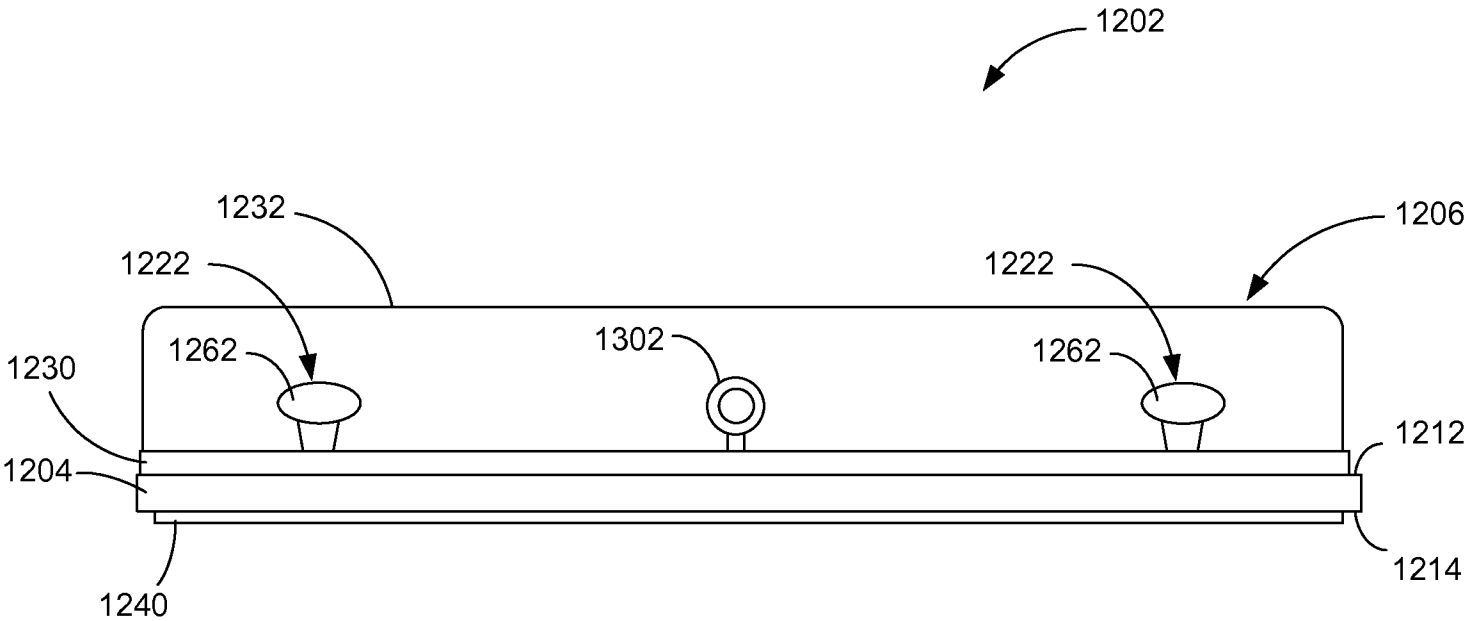
FIG. 13 is a lateral side elevation view of the first end of the exercise slide board of FIG. 12.
Figure 14:
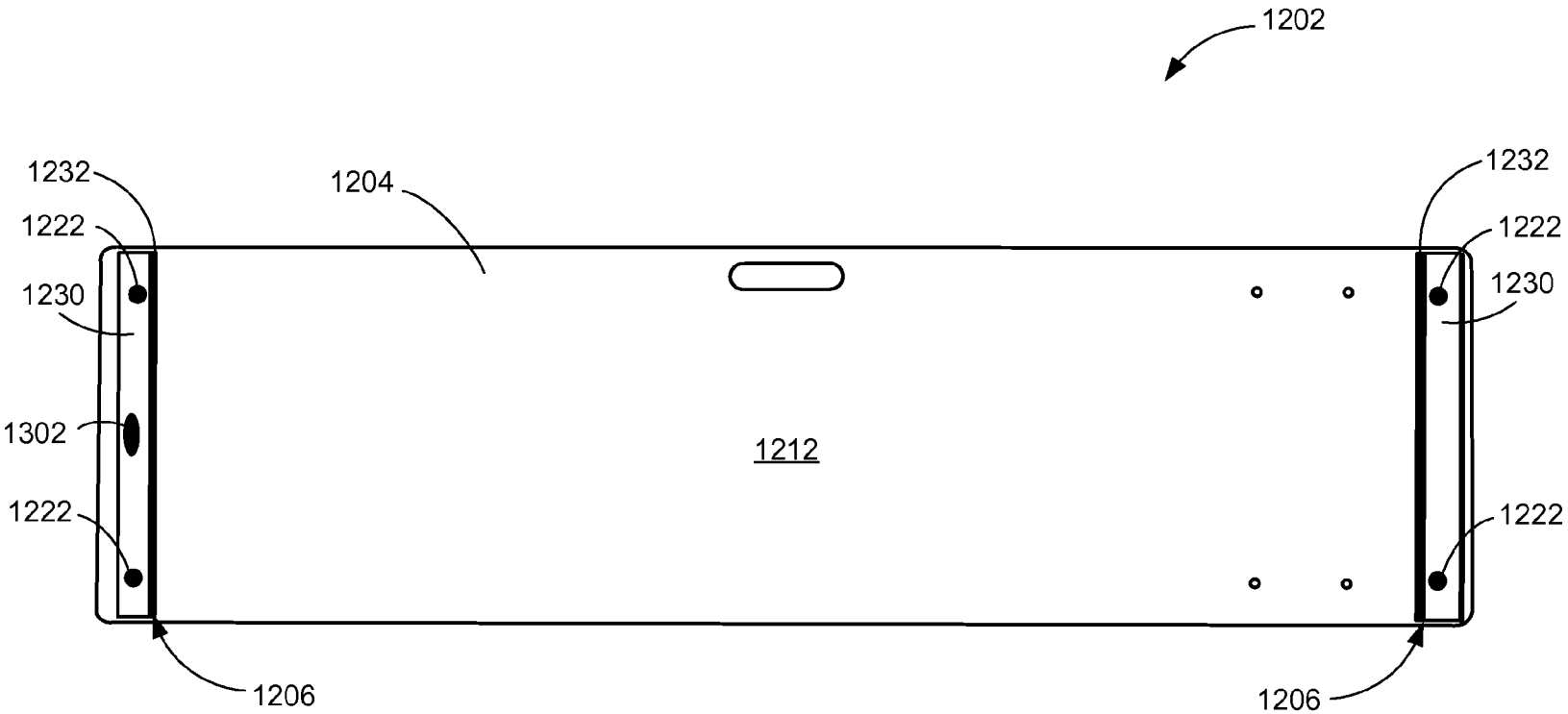
FIG. 14 is a top plan view of the exercise slide board of FIG. 12.

FIG. 12 is an enlarged cross-sectional front side view of a first end of an exercise slide board 1202, according to one embodiment. FIG. 13 is a lateral side elevation view of the exercise slide board 1202 of FIG. 12. FIG. 14 is a top plan view of the exercise slide board of FIG. 12. Referring generally and collectively to FIGS. 12-14, the slide board 1202 comprises a main board 1204, backstops 1206 and a floor grip unit 1240. The backstops 1206 are positioned on a top surface 1212 of a main board 1204. The main board 1204 of the slide board 1202 may be formed of high density polyethylene (HDP), similar to the embodiment of FIG. 1 described above. The top surface 1212 of the main board 1204 provides a low-friction surface upon which a user can easily slide.

The backstops 1206 may be mounted on or in abutment with the top surface 1212 of the main board 1204, as shown. The backstop 1206 is formed of clear ¼ inch Lexan® bent through an angle A1 to create a base portion 1230 and an upright portion 1232. An angle A2 is formed between the base portion 1230 and the upright portion 1232. In the illustrated embodiment, the Lexan may be bent through an angle A1 that may be ninety-five degrees to form an angle A2 that may be eighty-five degrees. In another embodiment, the angle A1 may be between ninety-three degrees and ninety-seven degrees. In another embodiment, the angle A1 may be between ninety-one degrees and ninety-nine degrees. In another embodiment, the angle A1 may be between ninety and one hundred degrees. The Lexan backstop 1206 may be bent using mechanical molding, such as using a press brake, or using a thermomolding process.

The Lexan backstops 1206 may be secured to the top surface 1212 of the main board 1204 with threaded mounting hardware 1222. A base surface 1219 of the backstop 1206 abuts against the top surface 1212 of the main board 1204. In the illustrated embodiment, the mounting hardware 1222 may include acrylic knobs 1262 with threaded studs 1264 to provide for quick and convenient adjustment of the backstop 1206 without a need for tools. The threaded studs of the mounting hardware 1222 may pass through a hole in the base portion 1232 of the backstop 1206 and engage a female threaded component 1266 positioned within backstop adjustment holes 1208. The female threaded component 1266 may be positioned at or below the top surface 1212 of the main board 1204 (and/or between the top surface 1212 and bottom surface 1214 of the main board 1204). The female threaded component 1266 may be configured to be firmly secured in the main board 1204 to prevent the female threaded component 1266 from pulling through the adjustment holes 1208 in response to forces against the backstops 1206. For example, the female threaded component 1266 may be barbed and/or comprise a collar or head 1268 to be positioned in abutment with a bottom surface 1214 of the main board 1204.

The acrylic knobs 1262 of the mounting hardware 1222 may be configured to enable a user to easily rotate (e.g., screw/unscrew) the mounting hardware 1222 without tools. Rotation of the acrylic knobs 1262 rotates the threaded studs 1264, thereby loosening or tightening securement of the backstop 1206. In the illustrated embodiment, at least a first backstop 1206 is removably mounted with the mounting hardware 1222 such that a distance between the strike surfaces 1220 of the backstops 1206 can be adjusted. The acrylic knobs 1262 allow a user to easily loosen the mounting hardware 1222 and adjust the position of the backstop 1206 to a different set of adjustment holes 1208 and then easily tighten the mounting hardware 1222 to secure the backstop 1206 to the main board 1204.

A floor grip unit 1240 is disposed on a bottom surface 1214 of the main board 1204. The floor grip unit 1240 in the illustrated embodiment may comprise a non-slip material attached directly to the bottom surface 1214 of slide board 1202 with an adhesive. The non-slip material may include, for example a non-slip rubber mesh configured to grip both a carpet flooring surface or a hard flooring surface (e.g., hardwood, tile). The non-slip rubber mesh may be formed of a durable woven fiber mesh laminated between layers of rubber or other non-slip material to provide durability and to resist tearing. As an example, in one embodiment the non-slip material may be a non-adhesive shelf liner, such as Duck® brand non-adhesive Easy Liner® shelf liner (e.g., item #47550 model #1297467 at Lowe's). The soft, pliable qualities secure the slide board 802 in place on a variety of surfaces without changing the gripping mechanism. The gripping mechanism is functional on both hard flooring surfaces and carpeted flooring surfaces. In the illustrated embodiment, the floor grip unit 1240 (e.g., non-slip material) may cover the entire bottom surface 1214 (or almost all of the bottom surface 1214) of the main board 1204 of the slide board 1202. The floor grip unit 1240 (e.g., non-slip material) extends along a length of the slide board 1202. In another embodiment, the non-slip material may include sections extending along a width of the slide board 1202 and positioned at intervals along the length of the bottom surface 1214 of the slide board 1202.

Referring specifically to FIG. 13, a threaded eyelet bolt 1302 is secured to the backstop 1206 and/or the main board 1204 to provide a connecting point for accessories, such as pull cables. FIG. 13 also illustrates that the floor grip unit 1240 (e.g., non-slip material) extends along a width of the slide board 1202. In another embodiment, the non-slip material may include sections extending along a length of the slide board 1202 positioned at intervals along the width of the bottom surface 1214 of the slide board 1202.

Figure 15:
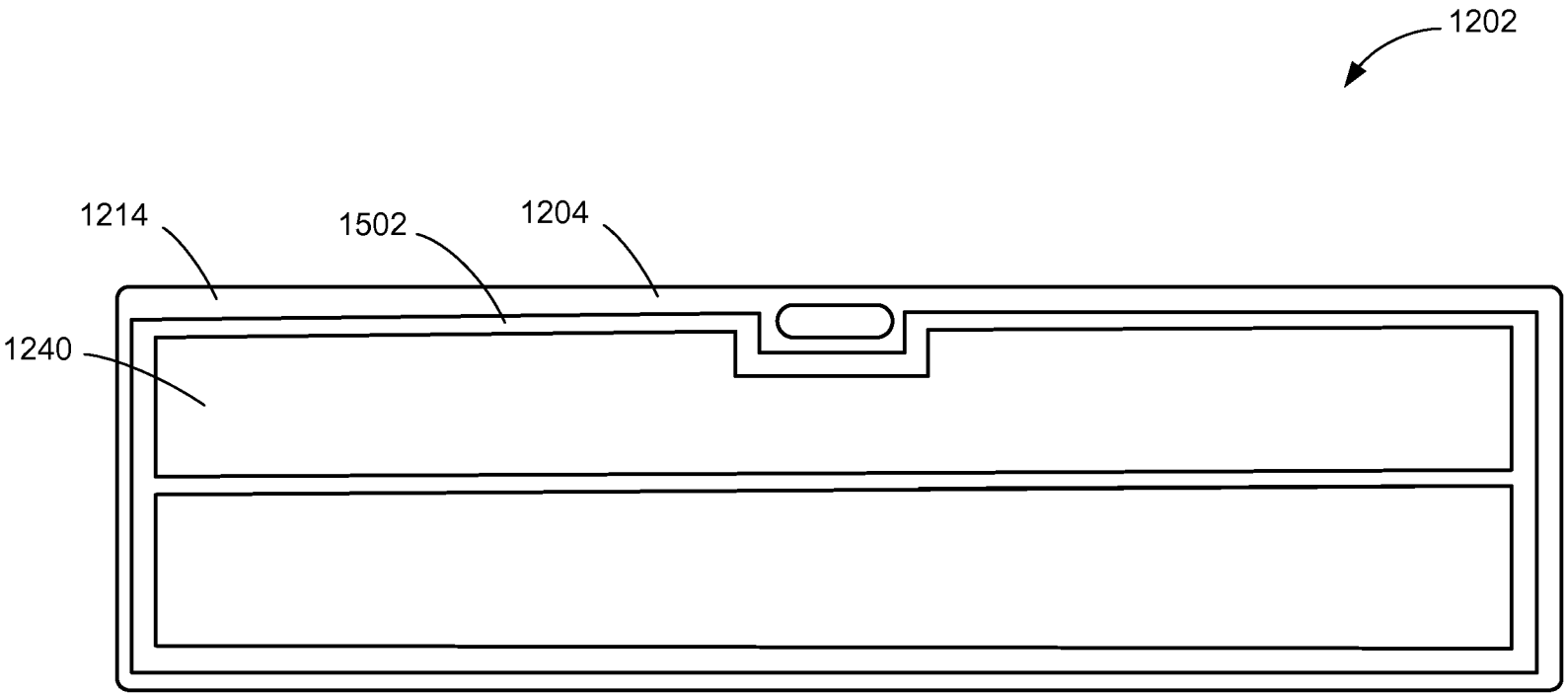
FIG. 15 is a bottom plan view of the exercise slide board of FIG. 12.

FIG. 15 is a bottom plan view of the exercise slide board 1202 of FIG. 12 illustrating positioning of double-sided adhesive tape 1502 configured to secure the floor grip unit 1240 (e.g., non-slip material) to the bottom surface 1214 of the main board 1204 of the slide board 1202, according to one embodiment. An ordinarily skilled artisan appreciates that a variety of patterns of adhesive tape may be used to secure non-slip material to the bottom surface 1214. Moreover, such ordinarily skilled artisan appreciates that a liquid adhesive such as glue may be used in place of the double-sided adhesive tape 1502.

Figure 17:
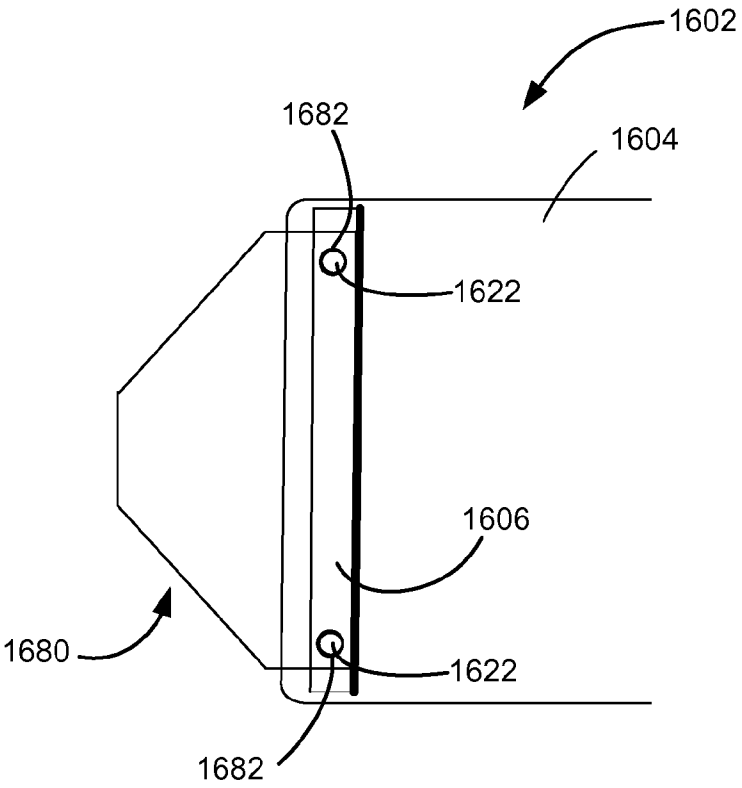
FIG. 17 is an enlarged top plan view of a second end of the exercise slide board with the door hanger coupled to the exercise slide board, according to one embodiment.
Figure 16:
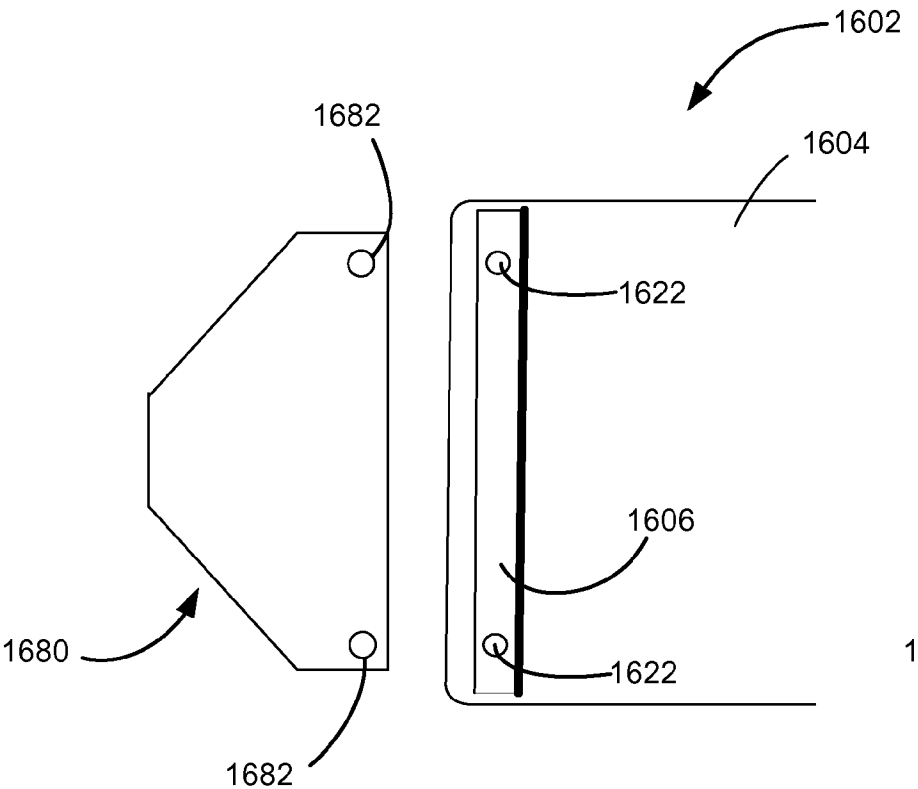
FIG. 16 is an enlarged top plan view of a second side of an exercise slide board with a door hanger uncoupled from the exercise slide board, according to one embodiment.
Figure 18:
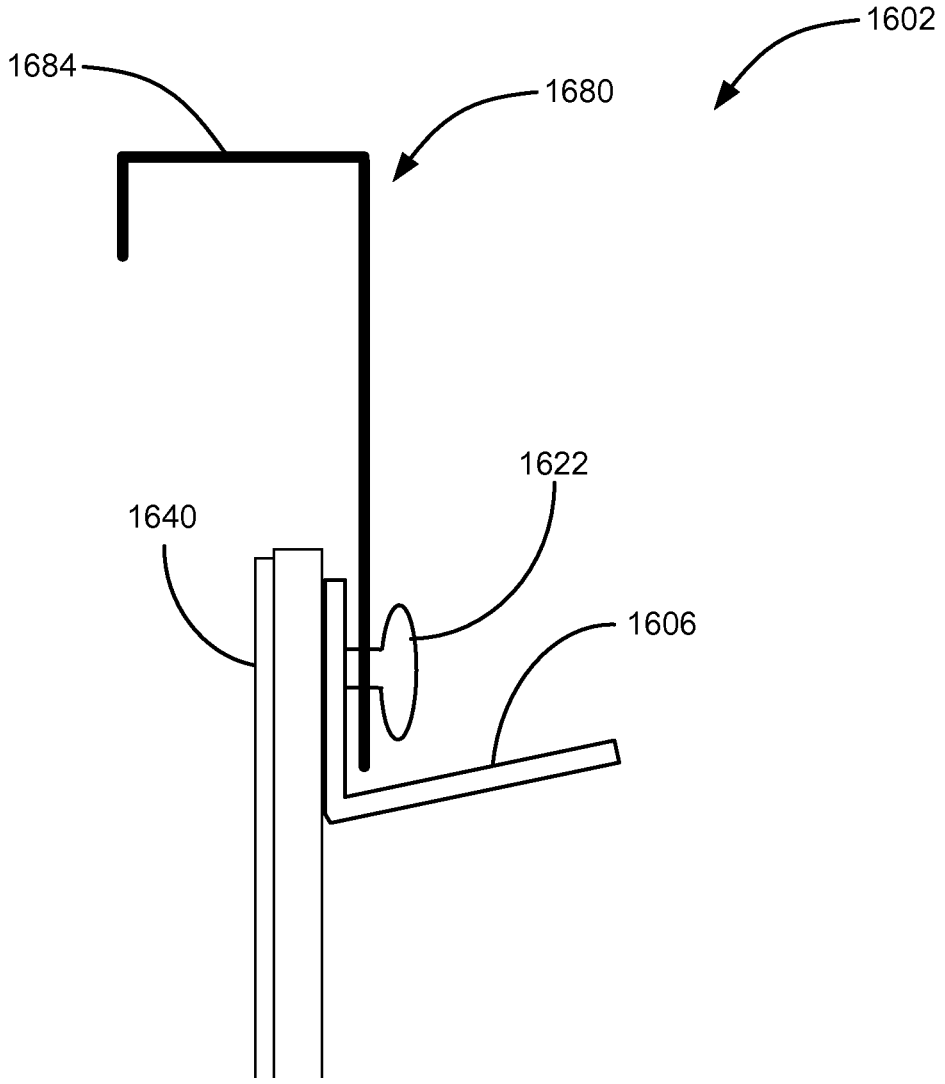
FIG. 18 is an enlarged front side view of a second end of the exercise slide board with the door hanger coupled to the exercise slide board, according to one embodiment.

FIG. 16 is an enlarged top plan view of a first lateral side of an exercise slide board 1602, according to another embodiment. A door hanger accessory 1680 is shown uncoupled from the exercise slide board 1602. FIG. 17 is an enlarged top plan view of a second end of the exercise slide board 1602 with the door hanger 1680 coupled to the exercise slide board 1602. FIG. 18 is an enlarged front side view of the second end of the exercise slide board 1602 with the door hanger accessory 1680 coupled to the exercise slide board 1602.

Referring generally and collectively to FIGS. 16 through 18, the door hanger accessory 1680 includes holes 1682 configured to engage the mounting hardware 1622 that secures the backstop 1606 to the main board 1604 of the slide board 1602. The door hanger accessory 1680 further includes a hook 1684 configured to be positioned over the top of a door, such as an interior door (e.g., a common door of a room or a closet). In the illustrated embodiment, the mounting hardware 1622 includes knobs that enable a user to easily adjust positioning of the backstops 1606, as described above. The holes 1682 of the door hanger accessory 1680 slide over the knobs of the mounting hardware 1622. Once the door hanger is coupled to the mounting hardware 1622, the hook 1684 can be positioned over a door to hang and store the slide board 1602. The hook 1684 may be configured to bend in the direction of the bottom surface 1602 of the main board 1604, as shown best in FIG. 18. A hook 1684 configured in this manner allows the floor grip unit 1640 (e.g., the non-slip material) to abut or be positioned proximate the door while the backstops 1606 protrude away from the door.

The foregoing specification has been described with reference to various embodiments. However, one of ordinary skill in the art appreciates that various modifications and changes can be made without departing from the scope of the present disclosure. Accordingly, this disclosure is to be regarded in an illustrative rather than a restrictive sense, and all such modifications are intended to be included within the scope thereof. Likewise, benefits, other advantages, and solutions to problems have been described above with regard to various embodiments. However, benefits, advantages, solutions to problems, and any element(s) that may cause any benefit, advantage, or solution to occur or become more pronounced are not to be construed as a critical, required, or essential feature or element. As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, system, article, or apparatus.

Those having skill in the art will appreciate that many changes may be made to the details of the above-described embodiments without departing from the underlying principles of the invention. The scope of the present invention should, therefore, be determined only by the following claims.

We claim:

1. An exercise slide board comprising:

a main board having a top surface and a bottom surface, the top surface being smooth and low friction;

first and second backstops at a first end of the main board and a second end of the main board, respectively, the first and second backstops having a base surface configured to abut against the top surface of the main board and a strike surface facing toward a center of the main board;

a floor grip device affixed on the bottom surface of the main board, the floor grip device configured to grip both hard flooring surfaces and carpeted flooring surfaces in a non-adhesive manner so as to create a frictional force to secure the main board relative to the flooring surface in response to and against a lateral force applied in a direction planar to the flooring surface and transverse to and against the strike surface of the first backstop or the second backstop;

mounting hardware to removably secure at least the first backstop to the top surface of the main board and to allow adjustment of a position of the first backstop on the top surface; and a door hanger configured to engage the mounting hardware and comprising a hook portion configured to extend beyond an edge of the main board, the hook to engage the top of a door and thereby hang the slide board on the door.

2. The exercise slide board of claim 1, wherein the floor grip device comprises a non-slip material affixed with an adhesive to the bottom surface of the main board, the non-slip material configured to grip both hard flooring surfaces and carpeted flooring surfaces.

3. The exercise slide board of claim 2, wherein the non-slip material is configured to cover the bottom surface of the main board.

4. The exercise slide board of claim 2, wherein the non-slip material is a rubber mesh comprising a woven fiber mesh disposed between layers of rubber.

5. An exercise slide board of claim 4, further comprising a hook coupled to at least one of the first and second backstops, the hook configured to attach a cable to the board.

6. An exercise slide board of claim 4, further comprising an opening through one of the first and second backstops, the opening configured to receive a door hanger accessory constructed and arranged to hang the board to a door for storage when not in use.

7. The exercise slide board of claim 1, wherein the each backstop comprises a base portion on which the base surface is positioned and an upright portion on which the strike surface is positioned, the upright portion protruding away from the base portion and the top surface of the main board to form an angle between the base portion and the upright portion.

8. The exercise slide board of claim 1, wherein the strike surface is configured to extend away from the top surface of the main board at an angle away from the center of the board, forming an angle with the board of greater than ninety degrees.

9. The exercise slide board of claim 1, wherein the angle between the strike surface and the board is ninety-five degrees.

10. The exercise slide board of claim, wherein the mounting hardware comprises a plurality of threaded pegs having a knob portion and a male threaded portion, the threaded portion configured to extend downward through a hole in the base surface of the backstop and engage a female threaded component embedded in the main slide board between the top surface and the bottom surface.

11. The exercise slide board of claim 1, wherein an upper surface of the female threaded portion is positioned level with or below the top surface of the main board.

12. The exercise slide board of claim 10, wherein the door hanger has a plurality of holes configured to receive and engage the knob portion of the mounting hardware.

13. The exercise slide board of claim 1, further comprising a hook coupled to at least one of the first and second back stops, the hook configured to attach a cable to the board.

14. An exercise slide board comprising:

a main board having a top surface and a bottom surface, the top surface being smooth and low friction;

first and second backstops at a first end of the main board and a second end of the main board, respectively, the first and second backstops having a base surface configured to abut against the top surface of the main board and a strike surface facing toward a center of the main board;

a floor grip device affixed on the bottom surface of the main board, the floor grip device configured to grip a flooring surface so as to create a frictional force to secure the main board relative to the flooring surface in response to and against a lateral force applied in a direction planar to the flooring surface and transverse to and against the strike surface of the first backstop or the second backstop;

mounting hardware to removably secure at least the first backstop to the top surface of the main board and to allow adjustment of a position of the first backstop on the top surface, the mounting hardware comprising a plurality of threaded pegs having a knob portion and a male threaded portion, the threaded portion configured to extend downward through a hole in the base surface of the backstop and engage a female threaded component embedded in the main slide board between the top surface and the bottom surface; and a door hanger having a plurality of holes configured to receive and engage the knob portion of the mounting hardware and comprising a hook portion configured to extend and hang over a door.

15. An exercise slide board comprising:

a main board having a top surface and a bottom surface, the top surface being smooth and low friction;

first and second backstops at a first end of the main board and a second end of the main board, respectively, the first and second backstops having a base surface configured to abut against the top surface of the main board and a strike surface facing toward a center of the main board;

a floor grip device affixed on the bottom surface of the main board, the floor grip device configured to grip a flooring surface so as to create a frictional force to secure the main board relative to the flooring surface in response to and against a lateral force applied in a direction planar to the flooring surface and transverse to and against the strike surface of the first backstop or the second backstop;

mounting hardware to removably secure at least the first backstop to the top surface of the main board and to allow adjustment of a position of the first backstop on the top surface; and a door hanger configured to engage the mounting hardware and comprising a hook portion configured to extend beyond an edge of the main board, the hook to engage the top of a door and thereby hang the slide board on the door.

* * * * *